US011673589B2

(12) United States Patent
Liodenot et al.

(10) Patent No.: US 11,673,589 B2
(45) Date of Patent: Jun. 13, 2023

(54) BOGIE FOR A RAILWAY VEHICLE AND ASSOCIATED RAILWAY VEHICLE

(71) Applicant: SpeedInnov, Paris (FR)

(72) Inventors: Frédéric Liodenot, Le Breuil (FR); Fabrice Cottin, Saint Firmin (FR)

(73) Assignee: SpeedInnov, Paris (FR)

( * ) Notice: Subject to any disclaimer, the term of this patent is extended or adjusted under 35 U.S.C. 154(b) by 444 days.

(21) Appl. No.: 16/774,464

(22) Filed: Jan. 28, 2020

(65) Prior Publication Data

US 2020/0239044 A1 Jul. 30, 2020

(30) Foreign Application Priority Data

Jan. 30, 2019 (FR) ..... 1900821

(51) Int. Cl.

| | |
|---|---|
| ***B61F 5/28*** | (2006.01) |
| ***B61C 3/00*** | (2006.01) |
| ***B61C 9/38*** | (2006.01) |

(52) U.S. Cl.

CPC ..... *B61F 5/28* (2013.01); *B61C 3/00* (2013.01); *B61C 9/38* (2013.01)

(58) Field of Classification Search

CPC ..... B61F 3/02; B61F 3/04; B61F 5/28; B61C 3/00; B61C 9/38

See application file for complete search history.

(56) References Cited

U.S. PATENT DOCUMENTS

| | | | |
|---|---|---|---|
| 6,283,869 B1 | 9/2001 | Spensberger | |
| 2010/0132585 A1 | 6/2010 | Rodet et al. | |

FOREIGN PATENT DOCUMENTS

| | | | | |
|---|---|---|---|---|
| CA | 2998814 | * | 9/2018 | B61B 3/00 |
| CA | 2998814 A1 | * | 9/2018 | B61B 13/00 |
| CN | 105313913 | | 2/2016 | |
| CN | 105313913 A | * | 2/2016 | B61C 9/50 |
| EP | 2058206 | | 5/2009 | |
| EP | 3272614 | * | 1/2018 | B61C 9/48 |
| EP | 3272614 A1 | * | 1/2018 | B61C 9/48 |
| FR | 2914606 | | 10/2008 | |
| FR | 3014397 | * | 6/2015 | B61C 9/50 |
| FR | 3014397 A1 | * | 6/2015 | B61C 9/50 |

OTHER PUBLICATIONS

Preliminary Search Report for French Application 1900821 dated Nov. 7, 2019.

* cited by examiner

*Primary Examiner* — Robert J McCarry, Jr.
(74) *Attorney, Agent, or Firm* — B. Aaron Schulman, Esq.; Stites & Harbison, PLLC

(57) ABSTRACT

The invention relates to a bogie (10) for a high-speed railway vehicle, comprising:

a bogie chassis, at least one wheel (20) mounted rotating on the chassis by means of an axle (18) and a primary suspension system (22), at least one motor (24), for each motor (24), at least one gearbox (26) able to mechanically link the motor (24) and the axle (18).

Each motor (24) is rigidly fastened to the chassis (12).

13 Claims, 3 Drawing Sheets

BOGIE FOR A RAILWAY VEHICLE AND ASSOCIATED RAILWAY VEHICLE

The present invention relates to a bogie for a high-speed railway vehicle, the bogie comprising:

a bogie chassis, at least one wheel mounted rotating on the chassis by means of an axle and a primary suspension system, at least one motor, for each motor, at least one gearbox able to mechanically link the motor and the axle.

The propulsion of high-speed railway vehicles, that is to say, able to reach speeds exceeding 300 km/h, requires powerful motors that generally have a substantial mass, that is to say, greater than 1100 kg in the case of an asynchronous motor and 900 kg in the case of a permanent magnet motor.

It is therefore known to fasten the motors to the body of the railway vehicle, in a suspended manner, and to transmit the rotation to the axles mounted on the bogies by a complex transmission shaft known as a "tripod".

This transmission shaft includes a ball joint-finger connection known as a Cardan joint, in order to accommodate the variations in orientation and the lateral movements between the body and the bogie, and therefore the substantial travel between the motor and the axle.

These transmission systems can be further improved.

Indeed, transmission shafts of the "tripod" type are generally expensive and heavy, and require a chrome surface treatment giving them a substantial hardness and guaranteeing their surface condition. However, these chrome treatments are harmful for the environment and should disappear as environmental standards evolve.

Additionally, the transmission by a Cardan joint is non-linear and causes energy losses in the transmission from the motor to the axle.

One aim of the invention is thus to provide a bogie for a high-speed railway vehicle comprising a transmission system making it possible to do away with the shaft of the "tripod" type.

To that end, the invention relates to a bogie of the aforementioned type, wherein each motor is fastened to the chassis rigidly.

Such a bogie makes it possible to do away with the tripod by eliminating the need to accommodate substantial lateral travel between the motor and the axle.

According to specific embodiments, the bogie according to the invention includes one or more of the following features, considered alone or according to any technically possible combination(s):

each motor comprises a protective and fastening carcass, the carcass defining fastening points, the motor being fastened to the chassis by rigid fastening members engaged in the fastening points of the carcass;

the carcass defines exactly four fastening points arranged so as to form a rectangle relative to one another;

two of the fastening points are located above a median plane of the chassis substantially perpendicular to an elevation direction of the chassis, and the other two fastening points are located below the median plane of the chassis;

the gearbox is able to transmit a torque generated by the motor to the axle substantially linearly;

each gearbox is suspended from the chassis by a suspension system having a single degree of freedom oriented essentially along an elevation direction of the chassis;

the gearbox is devoid of any element comprising a surface having a layer of chrome;

the bogie comprises a coupling device that mechanically links the motor to the gearbox, the coupling device comprising a coupling with a domed toothing; and each motor has a mass greater than or equal to 900 kg, preferably 1100 kg.

The invention also relates to a high-speed railway vehicle comprising at least one bogie as disclosed above, the railway vehicle being configured to move at speeds greater than or equal to 300 km/h during high-speed movement phases.

The invention will be better understood upon reading the following description, provided solely as an example and done in reference to the appended drawings, in which.

Figure 1:
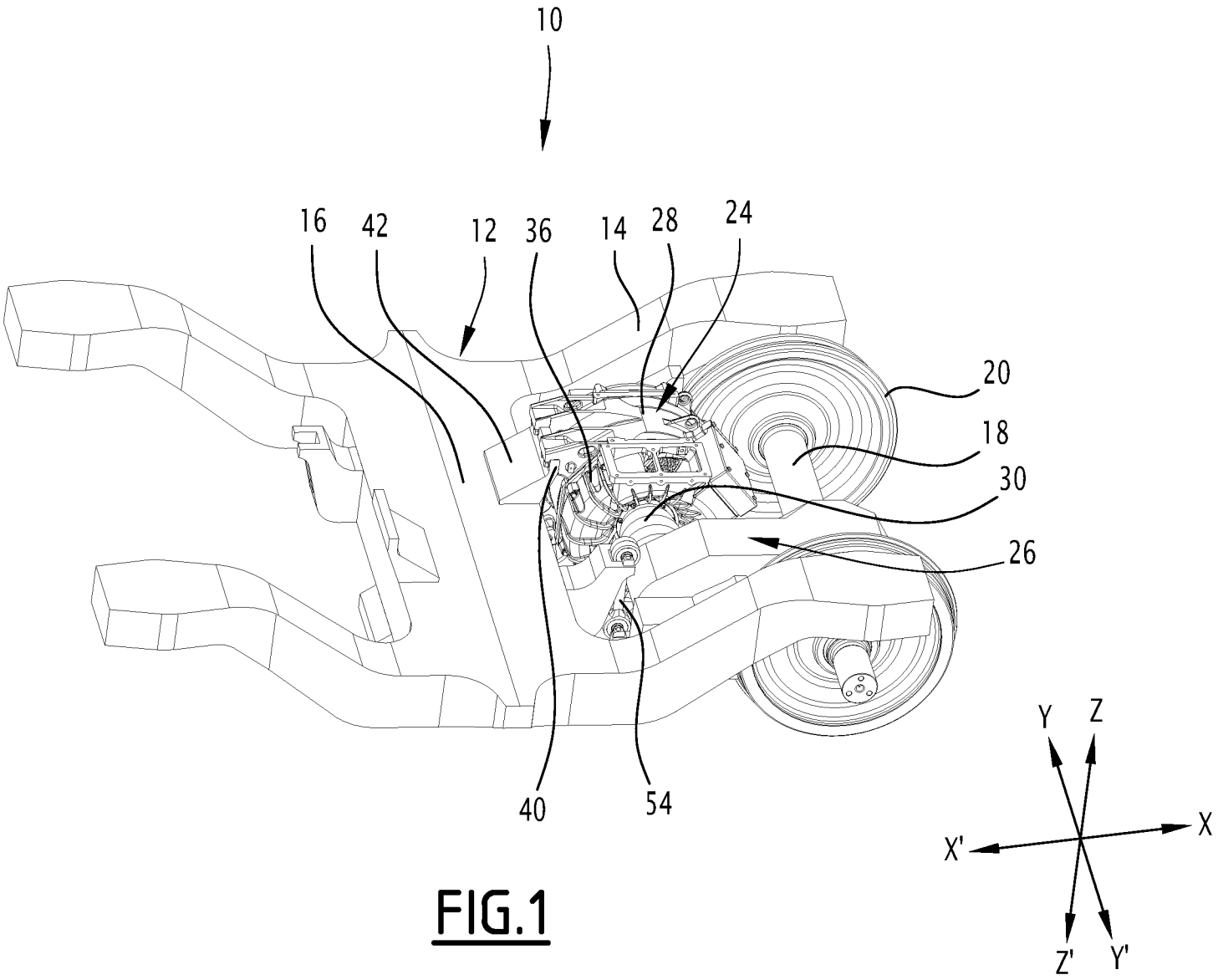
FIG. 1 is a partial perspective view of a bogie according to the invention.
Figure 2:
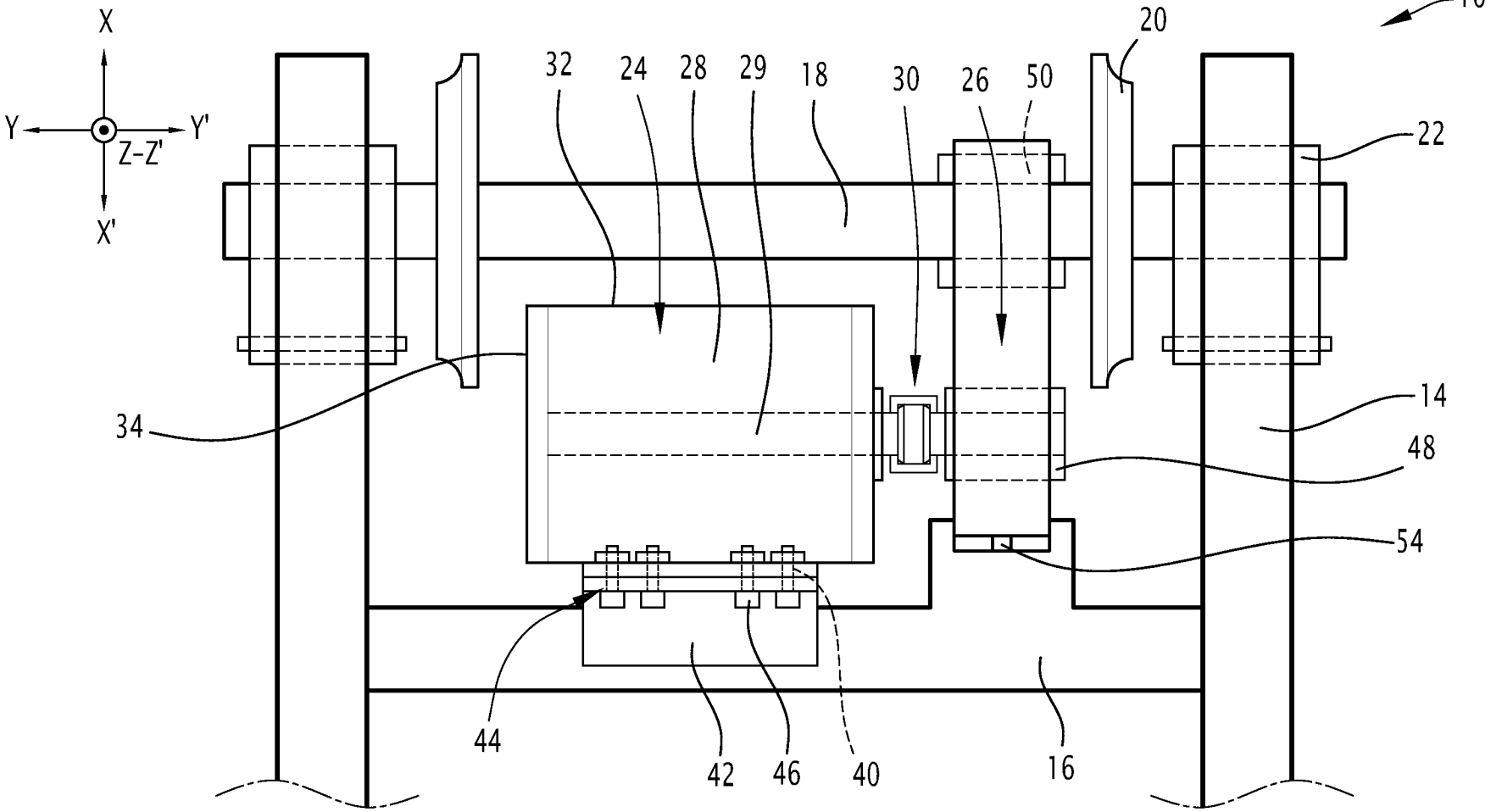
FIG. 2 is a schematic top view of the bogie of FIG. 1.
Figure 3:
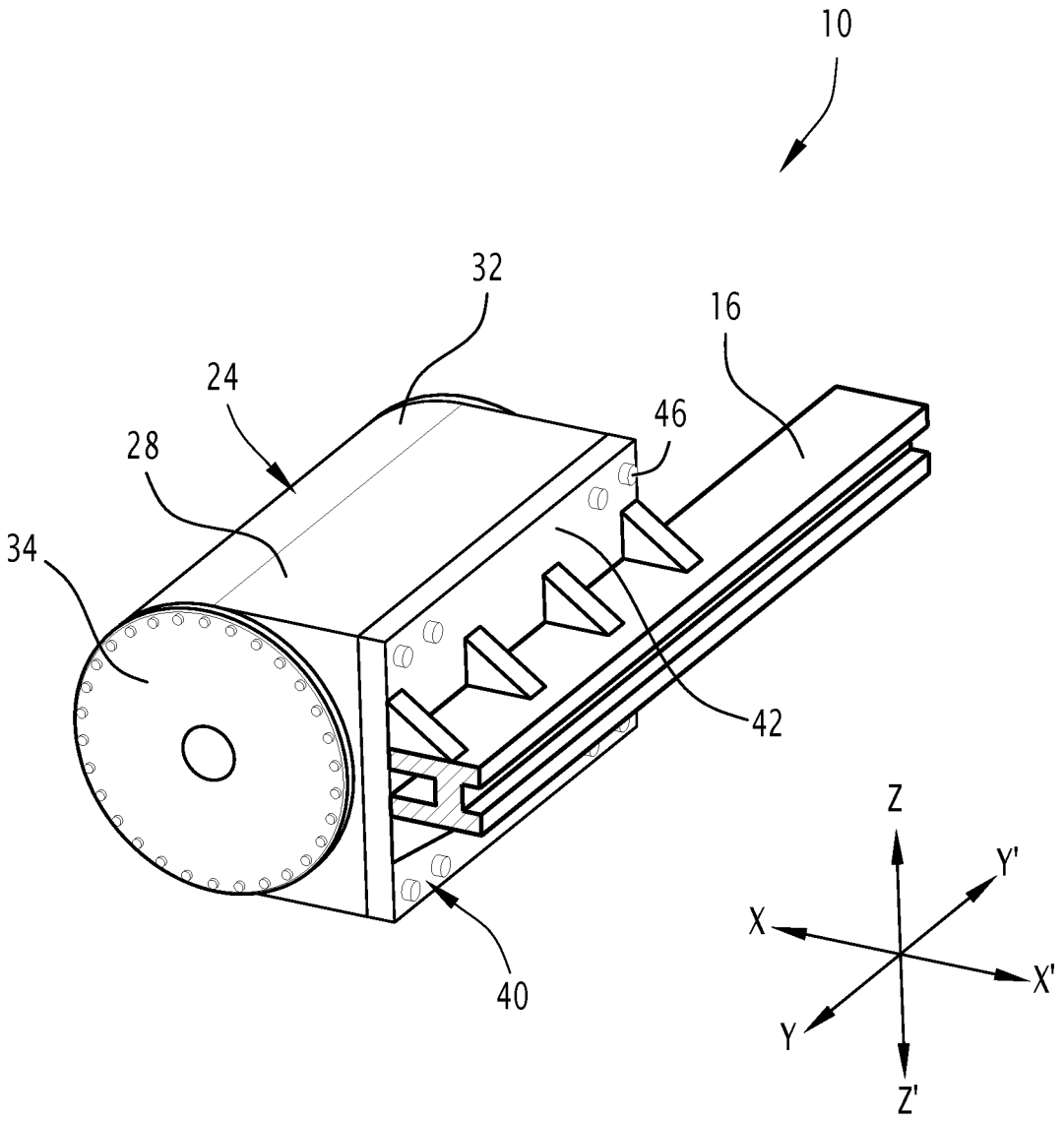
FIG. 3 is a perspective detail view of a bogie motor according to the invention.

A railway vehicle bogie 10 is disclosed in reference to FIGS. 1 to 3. The bogie 10 equips a high-speed railway vehicle, that is to say, a railway vehicle able to travel at speeds greater than or equal to 300 km/h during high-speed movement phases.

The bogie 10 is disclosed below in reference to a longitudinal direction X-X' substantially parallel to the direction of advance of the bogie 10 on rails, a transverse direction Y-Y' substantially perpendicular to the direction of advance of the bogie 10, and an elevation direction Z-Z', substantially orthogonal to the longitudinal direction X-X' and the transverse direction Y-Y'.

The longitudinal direction X-X' and the transverse direction Y-Y' are substantially horizontal and the elevation direction Z-Z' is substantially vertical, when the bogie 10 travels normally on substantially horizontal rails.

The bogie 10 comprises a chassis 12, comprising stringers 14 and at least one crosspiece 16 forming a frame. The bogie 10 also comprises axles 18 and wheels 20 supporting the chassis 12 through primary suspension systems 22.

The wheels 20 and the axles 18 are mounted on the chassis 12 rotating so as to allow the circulation of the bogie 10 on a railroad track.

The bogie 10 also comprises at least one motor 24 and at least one gearbox 26 that are configured to drive the rotation of the axles 18 and the wheels 20.

The chassis 12 in particular comprises two stringers 14 and one crosspiece 16, which are assembled so as to form a substantially H-shaped frame, by sets of fasteners (not shown) arranged at the ends of the crosspiece 16.

The stringers 14 extend substantially parallel to one another, in the longitudinal direction X-X', and the or each crosspiece 16 extends substantially in the transverse direction Y-Y'.

Advantageously, the bogie 10 comprises two motors 24 and two gearboxes 26 arranged on either side of the crosspiece 16, each motor 24 driving one of the axles 18 by means of one of the corresponding gearboxes 26.

In order to simplify the figures, a single motor 24, a single gearbox 26 and a single axle 18 are shown, the others being arranged substantially symmetrically relative to the center of gravity of the chassis 12.

The axles 18 extend substantially parallel to one another, along the transverse direction Y-Y'. The stringers 14 of the chassis 12 extend above the axles in the elevation direction Z-Z', and are carried by the primary suspension systems 22 (not visible in FIG. 1), which bear on the ends of each axle 18.

The wheels 20 are for example arranged inwardly relative to the stringers 14 and the primary suspension systems 22, along the transverse direction Y-Y'.

Each primary suspension system 22 comprises, in a known manner, at least one shock absorber and at least one resilient return element, such as a spring. The shock absorber and the resilient return element are both arranged between the stringer 14 and the axle 18, and are arranged to absorb the shocks and the vibrations transmitted from the wheel 20 to the chassis 12.

Each motor 24 comprises a protective carcass 28, as well as, in a known manner, a stator contained in the carcass for protection thereof and a rotor mounted rotating in the stator (not shown in the figures).

Each motor 24 is a high-speed railway vehicle motor, that is to say, able to cause the railway vehicle to reach a speed greater than or equal to 300 km/h. Each motor 24 has a mass greater than or equal to 900 kg, preferably 1100 kg.

The rotor rotates a rotor shaft 29 connected to a coupling device 30 that mechanically connects the motor 24 to the gearbox 26. The coupling device 30 is positioned between the rotor shaft 29 and the gearbox 26, and in particular between the rotor shaft 29 and an input pinion 48 of the gearbox 26.

The coupling device 30 advantageously comprises a coupling with a domed toothing comprising an input capable of cooperating with the rotor shaft 29 and an output capable of cooperating with an input pinion 48 of the gearbox 26.

The coupling with domed toothing makes it possible to compensate for axial, radial and angular misalignments between the rotor and the gearbox 26, in particular between the rotor shaft 29 and the input pinion 48 of the gearbox 26.

The coupling is said to be with domed toothing because it comprises, on its periphery at its input and its output, teeth having domed ridges and not straight ones. The teeth are in particular able to cooperate with complementary housings formed on the periphery of a sleeve of the coupling extending between the input and the output.

The coupling with domed toothing is for example as disclosed in WO 97/47894 A1 in FIGS. 1 and 5.

The carcass 28 comprises side walls 32, which are for example substantially cylindrical, two end flanges 34 closing the side walls 32, and superstructures 36 (not shown in FIGS. 2 and 3), in particular playing a heat dissipating role.

The carcass 28 defines a plurality of fastening points 40, arranged across from a support 42 carried by the crosspiece 16 when the motor is mounted on the chassis.

Advantageously, the carcass 28 defines four fastening points 40, arranged in the four corners of a rectangle, with two of the fastening points 40 located above a median plane of the chassis 12 that is substantially perpendicular to the elevation direction Z-Z', while the other two fastening points 40 are located below said median plane of the chassis 12.

The median plane of the chassis 12 is in particular a substantially horizontal plane, extending at mid-height with respect to the crosspiece 16 and stringers 14, along the elevation direction Z-Z', when the railway vehicle is traveling on horizontal rails.

Each fastening point 40 for example comprises a through duct having substantially smooth inner walls, capable of receiving a bolt.

In a variant, each fastening point 40 comprises a threaded orifice, emerging at just one or at both of its ends, capable of receiving a screw.

The support 42 is for example a plate substantially perpendicular to the longitudinal direction X-X', which defines a plurality of orifices 44, at least one of the orifices 44 emerging across from each of the fastening points 40 of the carcass 28.

Rigid fastening members 46 are engaged in a blocking manner both in the orifices 44 of the support 42 and in the ducts of the fastening points 40 of the carcass 28.

The fastening members 46 are for example bolts.

In a variant, the fastening members 46 are screws or rivets.

In the embodiments illustrated in FIGS. 2 and 3, each fastening point 40 comprises two substantially parallel through ducts, and the support 42 defines two orifices 44 across from each fastening point 40, each orifice 44 emerging in one of the ducts. Each fastening member 46 comprises two bolts substantially parallel to one another, each engaged in one of the orifices 44 and in one of the ducts. This embodiment makes it possible to increase the stiffness of the fastening of the motor 24 and to improve the security thereof.

Each gearbox 26 comprises the input pinion 48, cooperating with the output of the coupling device 30, and an output pinion 50 integral with the axle 18. The gearbox 26 transmits the mechanical driving of the coupling device 30 to the axle 18, which allows the motor 24 to rotate the wheels 20.

Each gearbox 26 is fastened to the chassis 12 by a respective suspension system, having a single degree of vertical freedom, that is to say, advantageously allowing travel of the gearbox essentially in the elevation direction Z-Z'.

The suspension system of the gearbox 26 for example comprises a pivot link allowing an articulation of the gearbox 26 in rotation relative to the chassis 12, around an axis substantially collinear to a central axis of the coupling device 30, such as a resilient return connecting rod 54.

The articulation of the gearbox 26 around the central axis of the coupling device 30 makes it possible to minimize the relative travel of the motor 24 and the gearbox 26 at its input pinion 48, which makes it possible to use the coupling device 30 instead of a shaft of the "tripod" type.

The gearbox 26 ensures a substantially linear transmission of the driving of the motor 24 to the wheels 20, that is to say, the torque transmitted to the wheels 20 depends substantially linearly on the torque generated by the motor 24, without nonlinearities during the rotation as is the case with a Cardan joint.

This makes it possible to reduce the energy losses in the transmission.

Additionally, the gearbox 26 does not comprise an element having a chrome-covered surface, since no element requires a significant hardness.

The invention claimed is:

1. A bogie for a high-speed railway vehicle, the bogie comprising:

a bogie chassis, at least one wheel mounted rotating on the bogie chassis using an axle and a primary suspension system, at least one motor, and at least one gearbox for each motor, wherein said at least one gearbox is able to mechanically link the motor and the axle, wherein each motor is rigidly fastened to the bogie chassis;

wherein the bogie chassis comprises two stringers; and wherein each primary suspension system comprises at least one shock absorber and at least one resilient return element, both said at least one shock absorber and said at least one resilient return element being arranged between the stringer and the axle.

2. The bogie according to claim 1, wherein each motor comprises a protective and fastening carcass, the carcass defining fastening points, the motor being fastened to the bogie chassis by rigid fastening members engaged in the fastening points of the carcass.

3. The bogie according to claim 2, wherein the carcass defines exactly four fastening points arranged so as to form a rectangle relative to one another.

4. The bogie according to claim 2, wherein the carcass defines at least:

two fastening points located above a median plane of the bogie chassis substantially perpendicular to an elevation direction of the bogie chassis, and two other fastening points located below the median plane of the bogie chassis.

5. The bogie according to claim 1, wherein the gearbox is able to transmit a torque generated by the motor to the axle substantially linearly.

6. The bogie according to claim 5, wherein each gearbox is suspended from the bogie chassis by a suspension system having a single degree of freedom oriented essentially along an elevation direction of the bogie chassis.

7. The bogie according to claim 1, wherein the gearbox is devoid of any element comprising a surface having a layer of chrome.

8. The bogie according to claim 1, wherein the bogie comprises a coupling device that mechanically links the motor to the gearbox, the coupling device comprising a coupling with a domed toothing.

9. The bogie according to claim 1, wherein each motor has a mass greater than or equal to 900 kg.

10. A high-speed railway vehicle comprising at least one bogie according to claim 1, the railway vehicle being able to move at speeds greater than or equal to 300 km/h during high-speed movement phases.

11. The bogie according to claim 2, wherein the rigid fastening members are engaged in the fastening points of the carcass in a blocking manner.

12. A bogie for a high-speed railway vehicle, the bogie comprising:

a bogie chassis, at least one wheel mounted rotating on the bogie chassis using an axle and a primary suspension system, at least one motor, and at least one gearbox for each motor, wherein said at least one gearbox is able to mechanically link the motor and the axle, wherein each motor is rigidly fastened to the bogie chassis;

wherein the bogie chassis comprises two stringers;

wherein each primary suspension system comprises at least one shock absorber and at least one resilient return element, both said at least one shock absorber and said at least one resilient return element being arranged between the stringer and the axle; and wherein the gearbox is able to transmit a torque generated by the motor to the axle substantially linearly.

13. A bogie for a high-speed railway vehicle, the bogie comprising:

a bogie chassis, at least one wheel mounted rotating on the bogie chassis using an axle and a primary suspension system, at least one motor, and at least one gearbox for each motor, wherein said at least one gearbox is able to mechanically link the motor and the axle, wherein each motor is rigidly fastened to the bogie chassis;

wherein the bogie chassis comprises two stringers;

wherein each primary suspension system comprises at least one shock absorber and at least one resilient return element, both said at least one shock absorber and said at least one resilient return element being arranged between the stringer and the axle;

wherein the gearbox is able to transmit a torque generated by the motor to the axle substantially linearly; and wherein each gearbox is suspended from the bogie chassis by a suspension system having a single degree of freedom oriented essentially along an elevation direction of the bogie chassis.

* * * * *